US006295655B1

(12) United States Patent
Johe

(10) Patent No.: US 6,295,655 B1
(45) Date of Patent: Oct. 2, 2001

(54) SHOULDER PROTECTION GUARD

(76) Inventor: Joon Hee Johe, 1035 Aster Ave. #1112, Sunnyvale, CA (US) 94086

( * ) Notice: Subject to any disclaimer, the term of this patent is extended or adjusted under 35 U.S.C. 154(b) by 0 days.

(21) Appl. No.: 09/477,156

(22) Filed: Jan. 4, 2000

(51) Int. Cl.[7] ..... A41D 27/26
(52) U.S. Cl. ..... 2/461; 2/45
(58) Field of Search ..... 2/461, 459, 268, 2/455, 44, 45, 468, 908, 467; 128/878, 876; 602/4, 5, 18, 20, 62; 224/257, 264, 265, 600, 901

(56) References Cited

U.S. PATENT DOCUMENTS

| | | | | |
|---|---|---|---|---|
| 980,421 | * | 1/1911 | Jordan | 2/455 |
| 2,487,423 | * | 11/1949 | Cast | 2/455 |
| 2,763,004 | * | 9/1956 | Sanders | 2/455 |
| 3,153,791 | * | 10/1964 | White | 2/455 |
| 4,168,544 | * | 9/1979 | Kallman | 2/94 |
| 4,642,815 | * | 2/1987 | Allen | 2/455 |
| 4,811,876 | * | 3/1989 | Riggi | 224/264 |
| 4,825,476 | * | 5/1989 | Andrews | 2/421 |
| 4,887,318 | * | 12/1989 | Weinreb | 2/268 |
| 5,226,192 | * | 7/1993 | Jones et al. | 2/44 |
| 5,477,558 | * | 12/1995 | Volker et al. | 2/455 |
| 5,546,601 | * | 8/1996 | Abeyta | 2/455 |
| 5,701,611 | * | 12/1997 | Rector et al. | 2/455 |
| 6,067,665 | * | 5/2000 | DePalma et al. | 2/468 |

* cited by examiner

*Primary Examiner*—Gloria M. Hale
*Assistant Examiner*—Tejash Patel
(74) *Attorney, Agent, or Firm*—Jerry H. Noh, esq.

(57) ABSTRACT

A protective guard worn to protect the surface of the shoulders from the pressure caused by straps and load of a bag. The protective guard has a shell made of a durable rigid material, shaped and configured for attaching to the upper and rear surfaces of the shoulders and the lower rear neck surface of the wearer. The shell has an inner surface making contact with the surfaces of the wearer and an outer surface making contact with the bag. A pad means is attached to the inner surface at predetermined regions corresponding to the upper and rear surfaces of the shoulders of the wearer. Located on the outer surface of the shell is a means to prevent slippage of the shoulder straps when placed on the shell. There are several means to prevent slippage of the shoulder straps on the shell. One means is a channel defined by a pair of ridges formed on the outer surface of the shell. In the alternative, the means can be a patch of rubbery material attached at predetermined regions. In another alternative, the means can be a strap member having a hook and loop fastening means inserted through a pair of slits extending through the shell at predetermined regions. Another alternative means to prevent slippage of the shoulder straps can be a snap means located at each of the strap-shell interface regions. The shell can be of a unitary piece of material or in the alternative, the shell can be comprised of a left shell half and a right shell half which are slideably connected by an elongated plate.

21 Claims, 2 Drawing Sheets

SHOULDER PROTECTION GUARD

BACKGROUND OF THE INVENTION

I. Field of the Invention

This invention pertains to shoulder protection items. More specifically, the invention concerns shoulder protection guards worn by wearers of heavy bags having one or more shoulder straps.

II. Description of the Prior Art

Bags having dual straps for wearing over corresponding shoulders are widely used for carrying miscellaneous items. The most common type of a dual shoulder strap bag is referred to as a backpack. Backpacks are used most commonly by students for carrying books and other school supplies. Also, hikers, soldiers, and campers use backpacks to carry miscellaneous gear. Other types of dual shoulder strap bags are used to carry many items from golf clubs to blowing machines. These bags are convenient and comfortable for carrying relatively light loads for a short period of time. However, problems can arise when heavy loads are carried repeatedly or for longer periods of time.

The most typical problem is that the shoulder straps can dig into the shoulders of the wearer causing great discomfort. As is generally known, the area of the upper shoulder is not well protected by any layer of muscle or any significant amount of skin padding.

Also, the straps of heavy load bags upon the shoulders exerts the greatest amount of pressure unevenly upon the outer portion of the shoulders. Consistent prolonged exposure to this type of uneven pressure can lead to reoccurring upper and lower back pain.

Several prior art have been made attempting to ease the above problems. Many padded shoulder straps have been designed. Also, shoulder straps having extra padding along the portion of the strap which makes contact with a wearer's shoulder have been designed. Also, many types of pads have been designed for attachment to the portion of the shoulder strap which makes contact with the wearer's shoulder surface. One such pad is taught by U.S. Pat. No. 4,887,318 issued to Weinreb. Weinreb's invention is a single piece of elongated shoulder pad made of a rubbery material having fastening means for attachment to the shoulder strap of a bag. Padded straps and pads such as the one taught by Weinreb are good at preventing straps from digging into the shoulders for bags having relatively medium to slightly heavy loads. However, these padded straps and pads do not protect the shoulders well against extra heavy loads. The force of extra heavy loads compresses and bends paddings which makes these padding ineffective in preventing the uneven exertion of force upon the outer portion of the shoulder. As a result, the padded straps and pads are ineffective in preventing the problem of reoccurring upper and lower back pain caused by prolonged and continual exposure to heavy loads upon the shoulders.

Thus, it is a primary objective of the present invention to provide a shoulder protection guard which prevents the shoulder straps from digging into the surface of the shoulder. It is another objective of the present invention to provide a shoulder protection guard which prevents the shoulder straps from applying uneven pressure upon the outer portions of the corresponding shoulders. It is yet another objective of the present invention to provide a shoulder protection guard which is relatively easy and inexpensive to manufacture.

SUMMARY OF THE INVENTION

This invention provides a protective guard worn to protect the surface of the shoulders from pain and discomfort caused by pressure from shoulder straps and to prevent the occurrence of back pain that can be caused by prolonged and consistent application of heavy pressure unevenly upon the outer portions of the shoulders. The protective guard has a shell upon which is applied all of the pressure from a shoulder strap. The shell is shaped and configured for attaching to the upper and rear surfaces of the shoulders and the lower rear neck surface of the wearer. The shell is made of a durable rigid material. The shoulder guard is first worn by the wearer, and a bag is next worn over the shell with the shoulder straps being placed over the shell. The shell has an inner surface making contact with the surfaces of the wearer and an outer surface making contact with the bag. A pad means is attached to the inner surface at predetermined regions corresponding to the upper and rear surfaces of the shoulders of the wearer. Also, located on the outer surface of the shell is a means to prevent slippage of the shoulder straps when placed on the shell. There are several means to prevent slippage of the shoulder straps on the shell. One means is a channel defined by a pair of ridges formed on the outer surface of the shell at predetermined regions corresponding to the position of the shoulder straps when the bag is worn over the shell (hereinafter referred to as "strap-shell interface region"). The corresponding shoulder straps are maintained within the corresponding channels. In the alternative, the means can be a patch of rubbery material attached at each of the strap-shell interface regions. In another alternative, the means can be a VELCRO strap having a VELCRO hook and loop fastening means inserted through a pair of slits extending through the shell at each of the strap-shell interface regions. Another alternative means to prevent slippage of the shoulder straps can be a snap means located at each of the strap-shell interface regions.

In the preferred embodiment, the shell is a unitary piece of material. In a second embodiment, the shell is comprised of two pieces of material, a left shield and a right shell each of a durable rigid material. Each of the left and right shells are shaped and configured for attaching to the upper and rear surfaces of the corresponding shoulders and the corresponding half of the rear lower neck surface of the wearer. Each of the left and right shells has a neck portion corresponding to the lower rear neck surface of the wearer and a shoulder portion corresponding to the corresponding shoulder surfaces of the wearer. An elongated plate of a durable rigid material slideably connects the neck portions of the left and right shells. The second embodiment further includes a means to slide one or both of the shells along the elongated plate to alter the distance between the left and right shells.

BRIEF DESCRIPTION OF THE DRAWING

With the above and additional objects and advantages in view, as will hereinafter appear, this invention comprises the devices, combinations and arrangements of parts hereinafter described, by way of example, and illustrated in the accompanying drawings of a preferred embodiment in which.

DESCRIPTION OF THE PREFERRED EMBODIMENT

Figure 1:
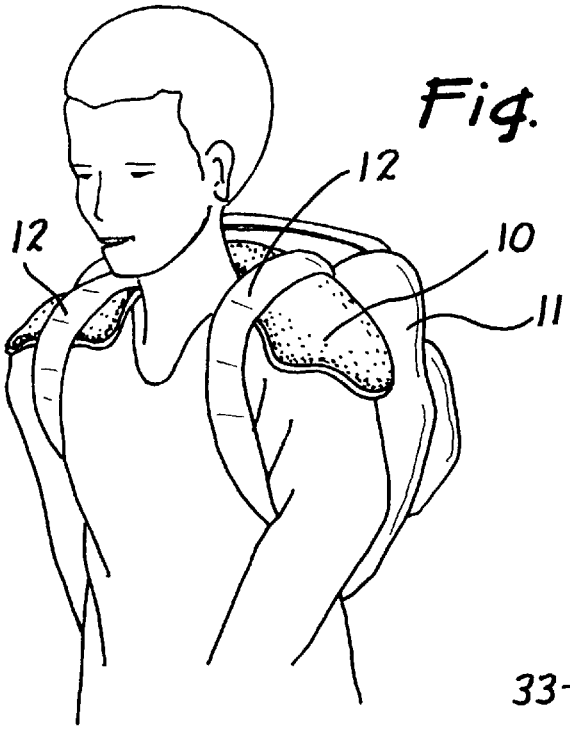
FIG. 1 is a perspective view showing a protective guard according to this invention applied to the shoulders and rear lower neck of a wearer.

FIG. 1 shows the preferred embodiment of the protective guard 10 of the present invention as worn by a wearer of a bag 11 having dual shoulder straps 12. The protective guard 10 has a protective shell 15 made of a durable rigid material. The material can be any rigid plastic, metal, or metal alloy. In the preferred embodiment, the material is a hard, rigid plastic due to its light weight. The protective shell 15 is shaped and configured for attaching to the upper and rear surfaces of the shoulders and the lower rear neck surface of the wearer. As shown in FIG. 1, the bag 11 is worn over the protective guard 10 with the shoulder straps 12 being placed over the shell 15.

Figure 5:
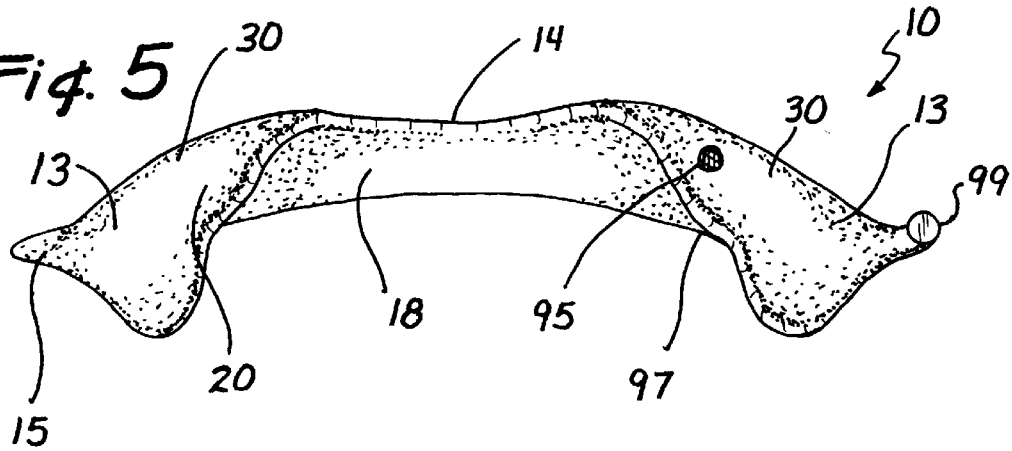
FIG. 5 is a front view of the present invention.

As shown in FIG. 5, the shell 15 has a pair of opposed shoulder portions 13 separated by a neck portion 14. Also, the shell 15 has an inner surface 18 which makes contact with the surfaces of the wearer and an outer surface 20 which makes contact with the bag 11. A pad means is attached to the inner surface 18 of the shell 15 along predetermined regions corresponding to the upper and rear surfaces of the shoulders of the wearer. The pad means can be a pad 24 made of natural rubber, synthetic rubber, or foam. The pad 24 is shaped and configured for attaching to the upper and rear surfaces of the shoulders of the wearer.

Figure 3:
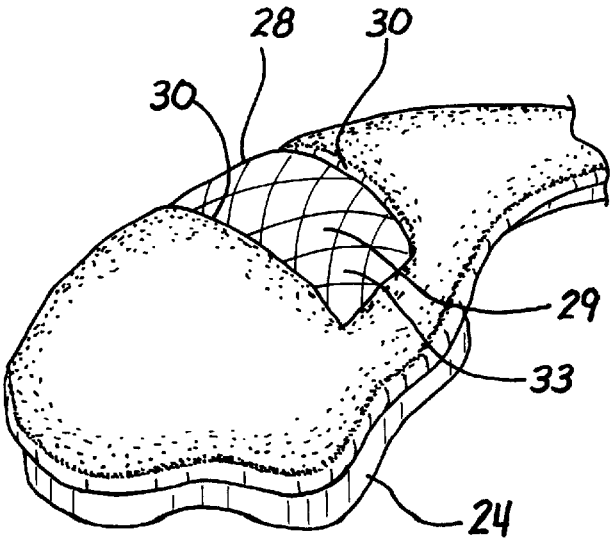
FIG. 3 is a view of the present invention wherein the means to prevent slippage is a channel.

The protective guard 10 further includes a means to prevent slippage of the shoulder straps 12 when the bag 11 is worn over the shell 15. The means to prevent slippage of the shoulder straps 12 is located at predetermined regions corresponding to the position of the shoulder straps 12 when the bag 11 is worn over the shell 15, which shall be referred to as the strap-shell interface region 28. The protective guard has two strap-shell interface regions 28, one on each shoulder portion 13. One means to prevent slippage of the shoulder straps 12 is a channel 29 defined by a pair of opposed ridges 30 formed at each strap-shell interface regions 28 as shown in FIG. 3. Each shoulder strap 12 is maintained within the corresponding channel 29 when a bag is worn over the shell 15. Another means to prevent slippage of the shoulder straps 12 is a patch of rubbery material 33 attached to the outer surface 20 at each strap-shell interface region 28.

Figure 4:
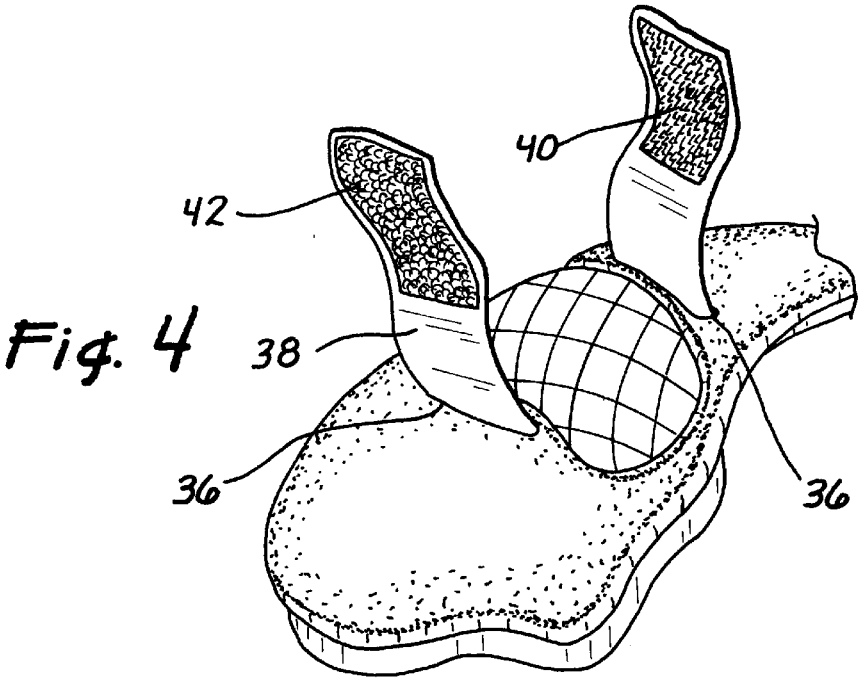
FIG. 4 is a view of the present invention wherein the means to prevent slippage is a VELCRO hook and loop fastener means.

Yet another means to prevent slippage of the shoulder straps 12 is a VELCRO hook and loop fastener. This means requires a pair of slits 36 to be made at each of the strap-shell interface regions 28. A strap member 38 having a VELCRO hook and fastening means is inserted through each pair of slits 36 as shown in FIG. 4. A corresponding shoulder strap 12 when placed between the pair of slits, can be wrapped by the strap member 38 with the VELCRO hook fastening members 40 removeably connecting to the VELCRO loop fastening members 42.

Figure 2:
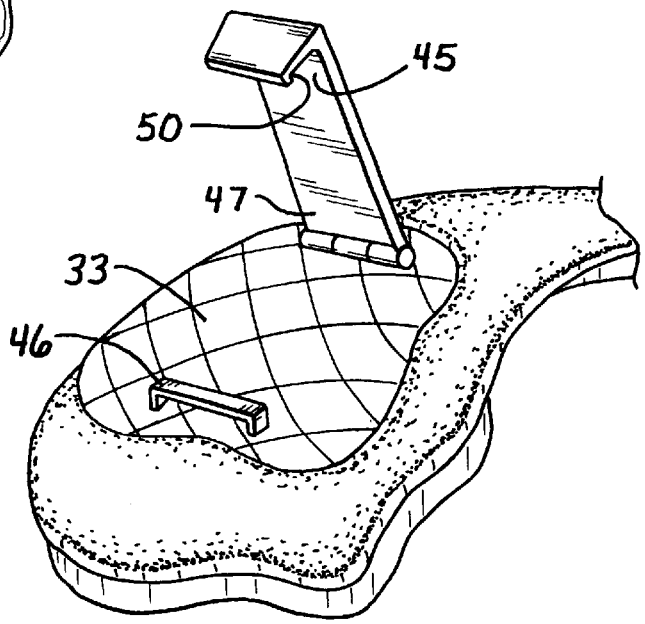
FIG. 2 is a view of the present invention wherein the means to prevent slippage is a snap means.

Another means to prevent slippage of the shoulder straps is a snap means attached at each strap-shell interface region 28 as shown in FIG. 2. The snap means includes an elongated snap member 45 and a corresponding catch member 46. The snap member 45 has a first end 47 hingeably attached to the outer surface 20 of the shell 15 and a second end 49 having a hooked tip 50. The catch member 46 is attached to the shell 15 and when the corresponding shoulder strap 12 is placed between the snap member 45 and the catch member 46, the snap member 45 is swung over the shoulder strap 12 and the hooked tip 50 is snapped onto the catch member 46.

The as illustrated in FIG. 5 protective guard 10 can have one or more speakers 95 and a corresponding speaker jack 97 built into the shell 15 for use with a portable audio device. In the preferred embodiment, the protective guard 10 has two speakers, one speaker on each shoulder portion 13. Furthermore, the protective guard can have one or more flashlights 99 built into the shell 15.

Figure 6:
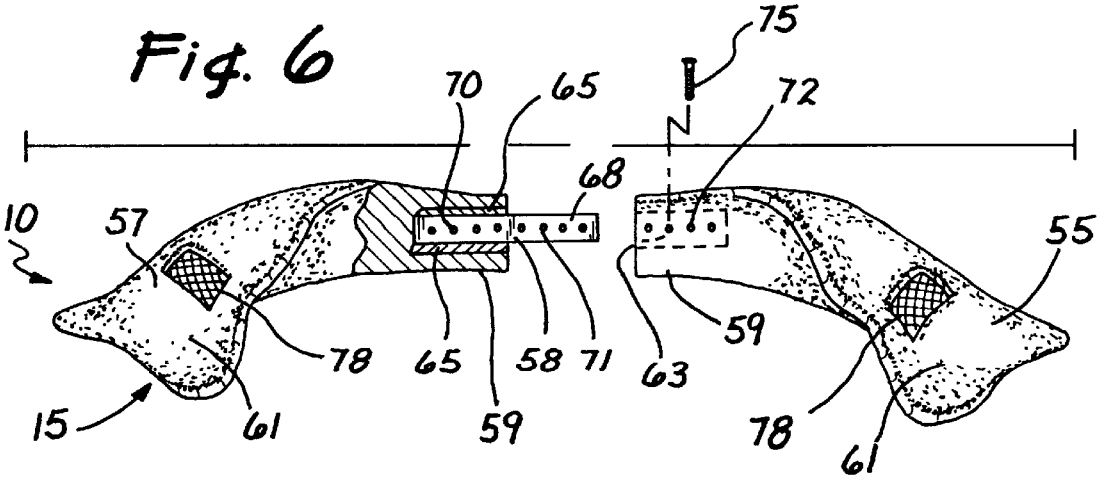
FIG. 6 is a cross-sectional view of the present invention.

In a second embodiment of the present invention as shown in FIG. 6, the shell 15 is divided into a protective left 55 and right 57 shell of a durable rigid material slideably connected by an elongated plate 58. Each of the left and right shells 55, 57 is shaped and configured for attaching to the upper and rear surfaces of the corresponding shoulders and the corresponding half of the lower rear neck surface of the wearer. Each of the left and right shells 55, 57 has a neck portion 59 corresponding to the lower rear neck surface of the wearer and a shoulder portion 61 corresponding to the corresponding upper and rear shoulder surfaces of the wearer. Within the neck portions 59 of each of the left and right shells 55, 57, is a channel 63 having a pair of steel framed lining 65.

The elongated plate 58 has a left half 68 located within the channel 63 of the left shell 55, and a right half 70 located within the channel 63 of the right shell 57. The elongated plate 58 is slideably engaged between the pair of steel framed lining 65 within each channel 63. The elongated plate 58 can be slid in and out of each channel 63 in order to increase and decrease the separation between the left and right shells 55, 57. In order to fix the elongated plate 58 at different lengths of separation between the left and right shells 55, 57, the elongated plate 58 has a plurality of threaded bores 70, and the neck portions 59 have a plurality of corresponding bores 72. The threaded bores 70 of the elongated plate 58 and the bores 72 of the neck portions 59 are arranged in a linear manner. To fix the separation distance between the left and right shells 55, 57, for each neck portion 59, a threaded pin 75 is inserted through the bore 72 of neck portion 59 and threadably engaged into the corresponding threaded bore 70 of the elongated plate 58.

As in the preferred embodiment, each shoulder portion 61 of the second embodiment has a pad means and a strap-shell interface region 78 having a means to prevent slippage of the shoulder straps which are identical to those of the preferred embodiment.

While a preferred embodiment of the invention has been described and illustrated for purposes of clarity and example, it should be understood that many changes, substitutions and modifications to the described embodiment will be apparent to those having skill in the art in light of the foregoing disclosure without departing from the scope and spirit of the present invention which is defined by the claim which will follow.

What is claimed is:

1. A protective guard for wearers of bags having a pair of shoulder straps, comprising:

a protective shell of a durable rigid material shaped and configured for attaching to the upper and rear surfaces of the shoulders and the lower rear neck surface of said wearer, whereby said bag is worn over said shell with said shoulder straps being placed over said shell;

said shell having a pair of opposed shoulder portions separated by a neck portion;

said shoulder portions corresponding to the upper and rear surfaces of the shoulders of said wearer; wherein each of the shell has a channel with a pair of ridges for receiving the shoulder straps and, said neck portion corresponding to the rear lower neck surface of said wearer.

2. A protective guard as described in claim 1 wherein said shell has an inner surface making contact with the surfaces of said wearer and an outer surface making contact with said bag, said shell further comprising a pad means attached to said inner surfaces of said shoulder portions.

3. A protective guard as described in claim 1 wherein said shell further comprises one or more speakers disposed on said shell and a corresponding speaker jack disposed on said shell.

4. A protective guard as described in claim 1 wherein said shell further comprises one or more flashlights disposed on said shell.

5. A protective guard as described in claim 1 wherein said shell further comprises:

a strap-shell interface region disposed on each shoulder portion, said strap-shell interface region corresponding to the position of said corresponding shoulder strap when said bag is worn over said shell; and, each of said strap-shell interface regions having a means thereon to prevent slippage of said corresponding shoulder strap when said bag is worn over said shell.

6. A protective guard as described in claim 5 wherein said means to prevent slippage of said shoulder straps is a patch of rubbery material attached to each of said strap-shell interface regions.

7. A protective guard as described in claim 5 wherein said means to prevent slippage of said shoulder straps comprises a pair of slits extending through the shell at each of said strap-shell interface regions, and a strap member having a hook fastening means and a corresponding loop fastening means extending through each of said pair of slits, whereby said corresponding shoulder strap is placed between said corresponding pair of slits and can be wrapped by said strap member with said hook fastening means removably attaching to said corresponding loop fastening means.

8. A protective guard as described in claim 5 wherein said means to prevent slippage of said shoulder straps is a snap means placed at each of said strap-shell interface regions.

9. A protective guard as described in claim 8 wherein said snap means comprises:

an elongated snap member having a first end hingeably attached to said outer surface of said shell and a second end having a hooked tip;

a corresponding catch member attached to said outer surface of said shell;

whereby when said corresponding shoulder strap is placed between said snap member and said catch member, said snap member is swung over said shoulder strap and said hooked tip is snapped onto said catch member.

10. A protective guard for wearers of bags having a pair of shoulder straps, comprising:

a protective left and right shell of a durable rigid material, each of said shells being shaped and configured for attaching to the upper and rear surfaces of the corresponding shoulders and the corresponding half of the lower rear neck surface of said wearer, whereby said bag is worn over said protective guard with said shoulder straps being placed over said corresponding left and right shells;

each of said left and right shells having a neck portion corresponding to the lower rear neck surface of the wearer and a shoulder portion corresponding to the corresponding upper and rear shoulder surfaces of the wearer;

an elongated plate of a durable rigid material slideably connecting said neck portions of said left and right shells; and, means to slide one or both of said shells along said elongated plates.

11. A protective guard as described in claim 10 further comprising a channel within said neck portions of each of said left and right shells, each of said channels having a pair of steel framed lining, said elongated plate being slideably engaged between said pair of steel framed lining within each of said channels.

12. A protective guard as described in claim 10 wherein said means to slide one or both of said shells along said elongated plates comprises:

a plurality of threaded bores placed in a linear row through said elongated plate;

a plurality of bores placed in a linear row through said neck portion of one or both of said shells corresponding to said threaded bores of said elongated plate, whereby a threaded pin can be inserted through said bore of said neck portion to threadably engage within said corresponding threaded bore of said elongated plate.

13. A protective guard as described in claim 10 wherein each of said left and right shells has an inner surface making contact with the surfaces of said wearer and an outer surface making contact with said bag, each of said left and right shells further comprising a pad means attached to said inner surface of said shoulder portion.

14. A protective guard as described in claim 10 wherein said shell further comprises one or more speakers disposed on said shell and a corresponding speaker jack disposed on said shell.

15. A protective guard as described in claim 10 wherein said shell further comprises one or more flashlights disposed on said shell.

16. A protective guard as described in claim 10 wherein each of said left and right shells further comprises:

a strap-shell interface region disposed on said shoulder portion, said strap-shell interface region corresponding to the position of said corresponding shoulder strap when said bag is worn over said left and right shells; and, each of said strap-shell interface regions having a means thereon to prevent slippage of said corresponding shoulder strap when said bag is worn over said left and right shells.

17. A protective guard as described in claim 16 wherein said means to prevent slippage of said shoulder straps is a channel defined by a pair of ridges formed at each of said strap-shell interface regions, whereby said corresponding shoulder straps is maintained within said corresponding channels.

18. A protective guard as described in claim 16 wherein said means to prevent slippage of said shoulder straps is a patch of rubbery material attached to each of said strap-shell interface regions.

19. A protective guard as described in claim 16 wherein said means to prevent slippage of said shoulder straps comprises a pair of slits extending through each of said left and right shells at said strap-shell interface regions, and a strap member having a VELCRO hook fastening means and a corresponding loop fastening means extending through each of said pair of slits, whereby said corresponding shoulder strap is placed between said corresponding pair of slits and can be wrapped by said strap with said hook fastening means removably attaching to said corresponding loop fastening means.

20. A protective guard as described in claim 16 wherein said means to prevent slippage of said shoulder straps is a snap means placed at each of said strap-shell interface regions.

21. A protective guard as described in claim 20 wherein said snap means comprises:

an elongated snap member having a first end hingeably attached to said outer surface of said shell and a second end having a hooked tip; and, a corresponding catch member attached to said outer surface of said shell;

whereby when said corresponding shoulder strap is placed between said snap member and said catch member, said snap member is swung over said shoulder strap and said hooked tip is snapped onto said catch member.

* * * * *